US007513210B1

(12) United States Patent
Salit et al.

(10) Patent No.: US 7,513,210 B1
(45) Date of Patent: Apr. 7, 2009

(54) MODULAR SPONSON WITH REPLACEABLE SECTIONS

(75) Inventors: Robert Salit, Panama City Beach, FL (US); Robert Peebles, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/447,520

(22) Filed: Jun. 5, 2006

(51) Int. Cl.
*B63B 7/06* (2006.01)
*B63B 59/02* (2006.01)

(52) U.S. Cl. ..... 114/352; 114/219; 114/343; 114/360

(58) Field of Classification Search ..... 114/219, 114/343, 345, 352, 360
See application file for complete search history.

(56) References Cited

U.S. PATENT DOCUMENTS

RE27,666 E * 6/1973 Dean
3,738,695 A * 6/1973 McBee ..... 293/128
4,074,649 A * 2/1978 Stranahan ..... 114/219
4,807,556 A * 2/1989 Hillier ..... 114/345

* cited by examiner

*Primary Examiner*—Sherman Basinger
(74) *Attorney, Agent, or Firm*—James T. Shepherd

(57) ABSTRACT

A modular sponson for a small boat has discrete sections disposed in a series from the bow and along both sides to the stern. Each section has an axially extending length of tubing defining a longitudinal opening and a plurality of elongate pieces of closed cell foam material secured to the outside of the tubing for the length of each section. Flotation structure outwardly disposed from and in contact with the elongate pieces is covered by a protective covering that reaches inwardly to opposite ends of each length of tubing. A bonding agent is provided on the tubing, elongate pieces, and flotation structure to hold them together in each discrete section of the modular sponson. An elongate cable extends through the longitudinal openings of the series of sections and exerts a tensile force to hold the sections adjacent one another in compression.

13 Claims, 4 Drawing Sheets

MODULAR SPONSON WITH REPLACEABLE SECTIONS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to sponsons for increasing stability and buoyancy of small boats. More particularly, this invention is to sponsons having a series of interconnected discrete sections that permit rapid removal and replacement of sections that might become damaged to quickly restore full operational capabilities.

Small motor-driven boats are used for a wide variety of demanding tasks requiring fast speed and quick responsiveness. One exemplary small fast boat is known as the rigid-hull inflatable boat (RHIB) of about 10 meters in length. The RHIB is a rugged, seaworthy, versatile boat designed for short range insertion and extraction of personnel, coastal resupply and surveillance.

Referring to FIG. 1, a small boat 6 such as the RHIB has an air-filled sponson 7 that is connected to and extends along a shell-like metal or fiberglass rigid central hull 8 in a continuous mounting-interface 9. Sponson 7 reaches from the bow and along both sides to the stern of central hull 8 and usually has one or more enclosed chambers 7A that optionally can be filled with foam instead of air. Mounting interface 9 can be a series of mating portions on sponson 7 and hull 8 securely engaging one another in accordance with well known techniques/means routinely practiced in the art. Sponson 7 stabilizes boat 6 and increases the payload while improving control and handling characteristics particularly in rough-water.

However, a problem with contemporary sponson-equipped boats is that each air-filled or solid-foam sponson 7 has one or more internal chambers 7A that are integrally formed as a unit, and these chambers 7A are vulnerable to damage by puncture, ripping, impact, etc. Consequently, if only a single chamber 7A of a contemporary sponson 7 is damaged to the extent of being non-repairable in the field, the damaged/flooded chamber can make the entire boat 6 inoperable.

As a result, many otherwise capable boats are abandoned when their sponsons are damaged. The other option is to load-up the disabled boat and haul it to a distant repair facility. There, the partially damaged sponson is totally removed and discarded, and a completely new sponson is installed. This procedure is not only expensive (a new complete sponson costs about $12,000.00 for the RHIB) but so much time can be spent that, effectively, a boat can be shut down when and where it is most likely to be needed.

Thus, in accordance with this inventive concept, a need has been recognized in the state of the art for a modular sponson for a boat made up of a discrete sections that permit rapid removal and replacement of damaged sections with new sections in the field to assure continuing operational readiness.

SUMMARY OF THE INVENTION

The present invention provides a modular sponson for a boat having a bow, sides and a stern. Discrete sections are disposed in a series from the bow and along both sides to the stern. Each discrete section has an axially extending length of tubing defining a longitudinal opening, elongate pieces of closed cell foam material secured to the outside of the tubing for substantially the entire length of each section, flotation structure outwardly disposed from and in contact with the elongate pieces, and a protective covering on the outside of the flotation structure and reaching inwardly to opposite ends of the length of tubing. The elongate pieces of closed cell foam orthogonally extend outward from the tubing for substantially the entire length of each section of the series. An elongate cable extends through longitudinal openings of the series of sections and exerts a tensile force to hold the series of discrete sections adjacent one another in compression. A bonding agent is disposed on each length of tubing, elongate pieces, and flotation structure, and sections of the series in the modular sponson have substantially the same lateral and longitudinal outer dimensions. Each section is cylindrical-shaped and each longitudinal opening axially extends through each cylindrical-shaped section. End plates each having a hole are on end ones of the series of discrete sections at the stern, and securing means at opposite ends of the elongate cable engage the end plates where the cable extends through the holes in the end plates. The end plates and the securing means thereby permit the elongate cable to exert a tensile force holding the series of discrete sections in compression throughout the length of the cable where it extends across the bow and along both sides to said stern. The protective covering is disposed outside of the flotation structure to resist abrasion and tearing of each discrete section, and a rubberized coating can be adjacent to the protective covering on each discrete section.

An object of the invention is to provide a modular sponson for a boat permitting replacement of sections of the sponson in the field.

Another object of the invention is to provide a modular sponson for a boat permitting rapid removal and replacement of damaged sections.

Another object of the invention is to provide a sponson having a series of modular sections allowing rapid replacement of damaged sections.

Another object of the invention is to provide a sponson made from a series of modular sections held together on a cable extending from the bow and back along the sides to the stern of a boat.

Another object of the invention is to provide a modular sponson having a cable holding together a series of discrete foam-filled/air-filled sections.

Another object of the invention is to provide a modular sponson having a cable mounting a series of sections including a central PVC tube wrapped by layers of closed-cell foam.

Another object of the invention is to provide a modular sponson having a cable mounting a series of sections including a central PVC tube with orthogonally disposed longitudinal pieces wrapped by layers of closed-cell foam.

Another object of the invention is to provide a modular sponson having a cable mounting a series of sections including a central PVC tube with orthogonally disposed longitudinal pieces wrapped by layers of closed-cell foam inside of a layer of rubberized heavy-duty material.

Another object of the invention is to provide a modular sponson having a cable mounting a series of sections including a central PVC tube with orthogonally disposed longitudinal pieces wrapped by at least one layer of closed-cell foam and an outer air-filled layer inside of rubberized heavy-duty material.

Another object of the invention is to provide a modular sponson having a cable mounting a discrete series of sections inside of an abrasion resistant covering for protection from puncture, cuts, and slashes.

These and other objects of the invention will become more readily apparent from the ensuing specification when taken in conjunction with the appended claims.

DESCRIPTION OF THE PREFERRED EMBODIMENT

Figure 1:
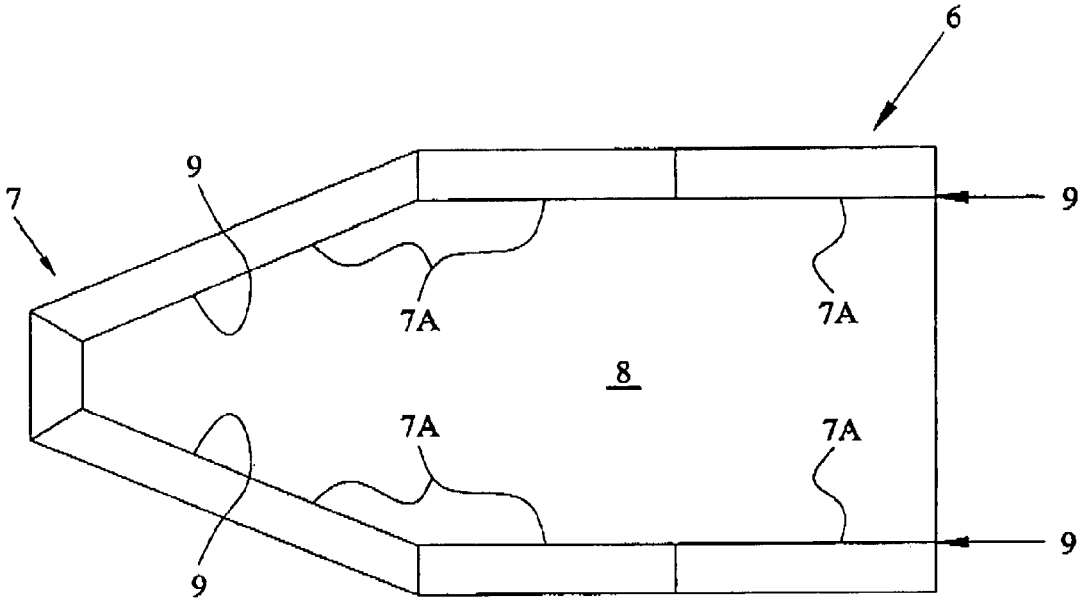
FIG. 1 (PRIOR ART)
FIG. 1 is a schematic top view of a prior art boat having a conventional sponson with one or more internal air or foam-filled chambers integrally formed as a unit and extending from the bow and back along both sides of a hull.
Figure 2:
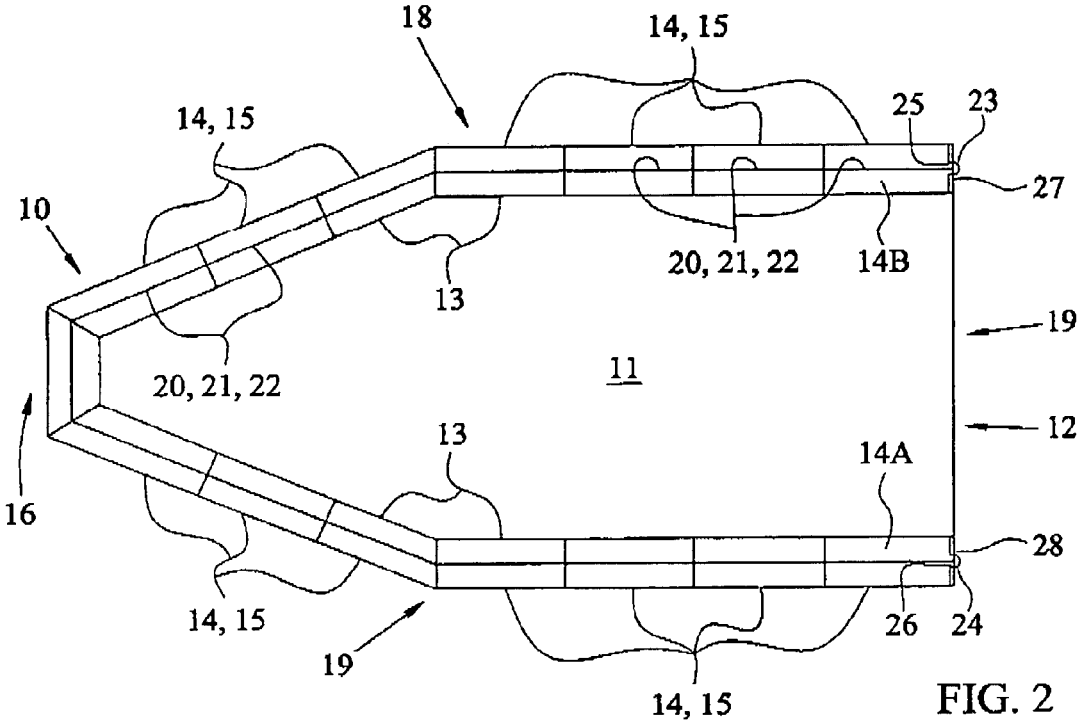
FIG. 2 is a schematic top view of the modular sponson of the invention having a cable extending through discrete replaceable sections disposed at the bow and along both sides to the stern of a boat's hull.

Referring to FIG. 2, modular sponson 10 of the invention extends along a shell-like rigid central hull 11 of a small boat 12 such as the RHIB referred to above and is connected to hull 11 in a continuously extending juncture 13. Modular sponson 10 has a plurality of discrete cylindrical-shaped sections 14 arranged in a series 15 to reach from the bow 16 and along both sides 17 and 18 to the stern 19 of central hull 11. Individual ones of cylindrical-shaped sections 14 of modular sponson 10 of the invention are interconnected to hull 11 along juncture 13 by well-known means (not shown). For example, these means of juncture 13 can be mechanically mating/adhering portions on hull 11 and each of cylindrical sections 14 that engage one another in accordance with well known techniques/means routinely practiced in the art to securely and reliably interconnect modular sponson 10 and hull 11 together.

Preferably all of cylindrical sections 14 can be made to have substantially the same lateral and longitudinal outer dimensions to reduce fabrication costs and simplify replacement and reassembly. However, some designs of hull 11 for differently shaped boats may require different shapes other than cylindrical for sections 14 of series 15. In addition, differently dimensioned sections 14 may also be needed within series 15 to properly fit along bow 16 and sides 17 and 18 of some boat designs to create a substantially smooth and uninterrupted surface for acceptable high speed travel across the water. One of sections 14 located at the apex of bow 16 may be slightly shorter in length than the other sections.

Figure 6:
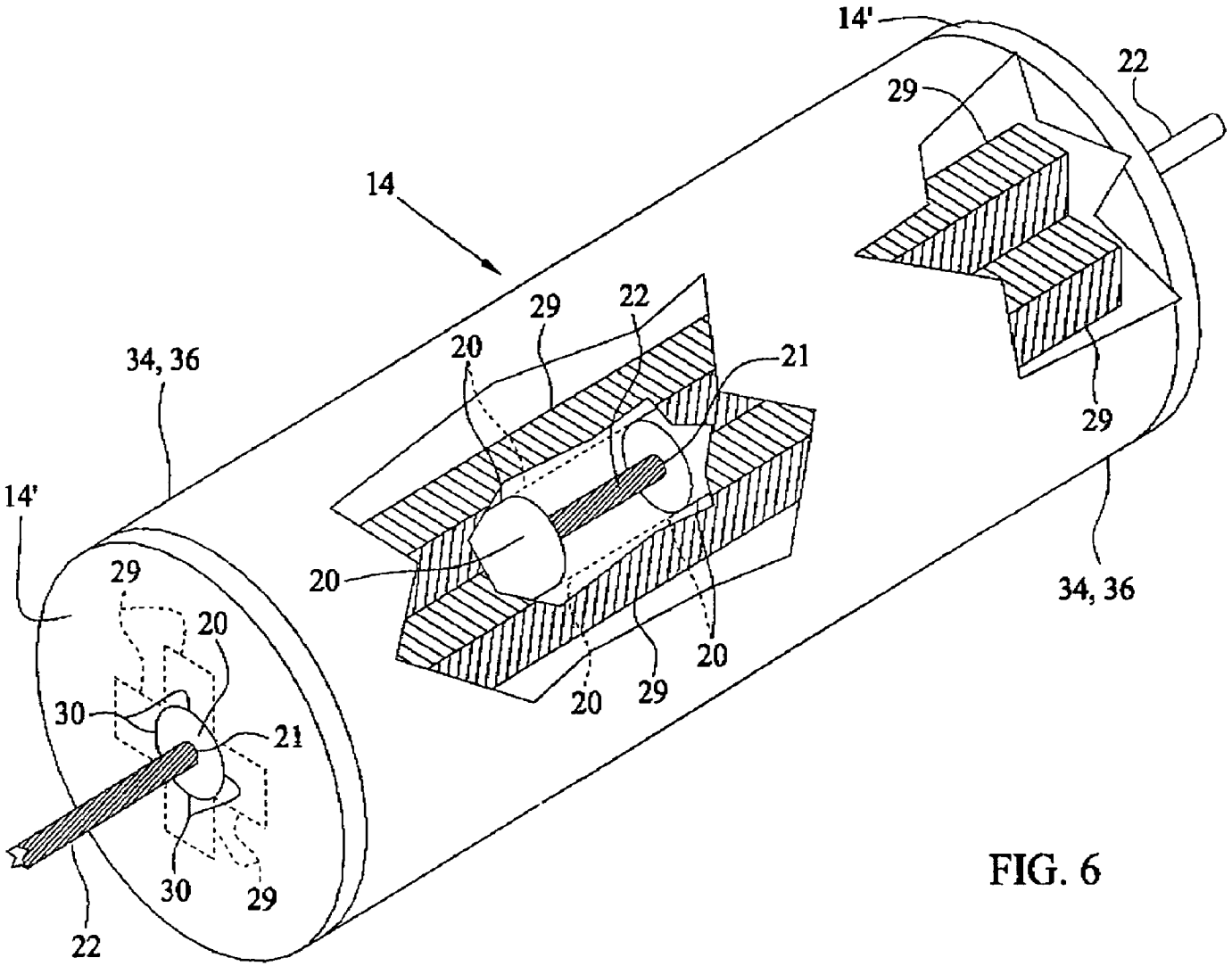
FIG. 6 is an isometric view partially in cross section of a discrete section of the modular sponson of the invention.

Referring also to FIG. 6, each cylindrical section 14 has an axially extending length of hollow tubing 20, preferably made of poly vinyl chloride (PVC). Each tubing 20 has a longitudinally extending opening, or an elongate coaxial bore 21 sized to receive an elongate cable 22 and permit cable 22 to longitudinally slide through it. Cable 22 can be inserted or withdrawn through all bores 21 of cylindrical sections 14. Cable 22 has securing means 23 and 24 (FIG. 2) such as knotted or clamped cable ends at its opposite ends on opposite sides of boat 12 at stern 19. Securing means 23 and 24 are on the opposite ends of cable 22 where they extend through holes 25 and 26 in end plates 27 and 28 on aft ends of end ones 14A and 14B of sections 14 at stern 19. Cable 22 is tensioned so that it exerts a tensile force on end plates 27 and 28 adjacent end sections 14A and 14B via securing means 23 and 24, and this tensile force holds series 15 of sections 14 in compression throughout the length of cable 22 as it extends across bow 16 and along both sides 17 and 18 to stern 19. The tensile force also securely aligns adjacent ones of discrete cylindrical sections 14 to maintain a smooth, dynamically streamlined shape for modular sponson 10.

In addition to plates 27 and 28 at opposite ends of series 15, a disc-shaped section-end-plate 14' with openings for tubing 20 can optionally be provided at opposite ends of each discrete section 14, see FIG. 6. Compression of adjacent ones of sections 14 along series 15 by the tensile force exerted by cable 22 brings adjacent ones of section-end-plates 14' in forceful abutting contact. This forceful abutting contact tends to press-away any irregularities that might otherwise have been inadvertently created on the ends of discrete sections 14 during fabrication to help assure the smooth streamlined shape of modular sponson 10.

Figure 3:
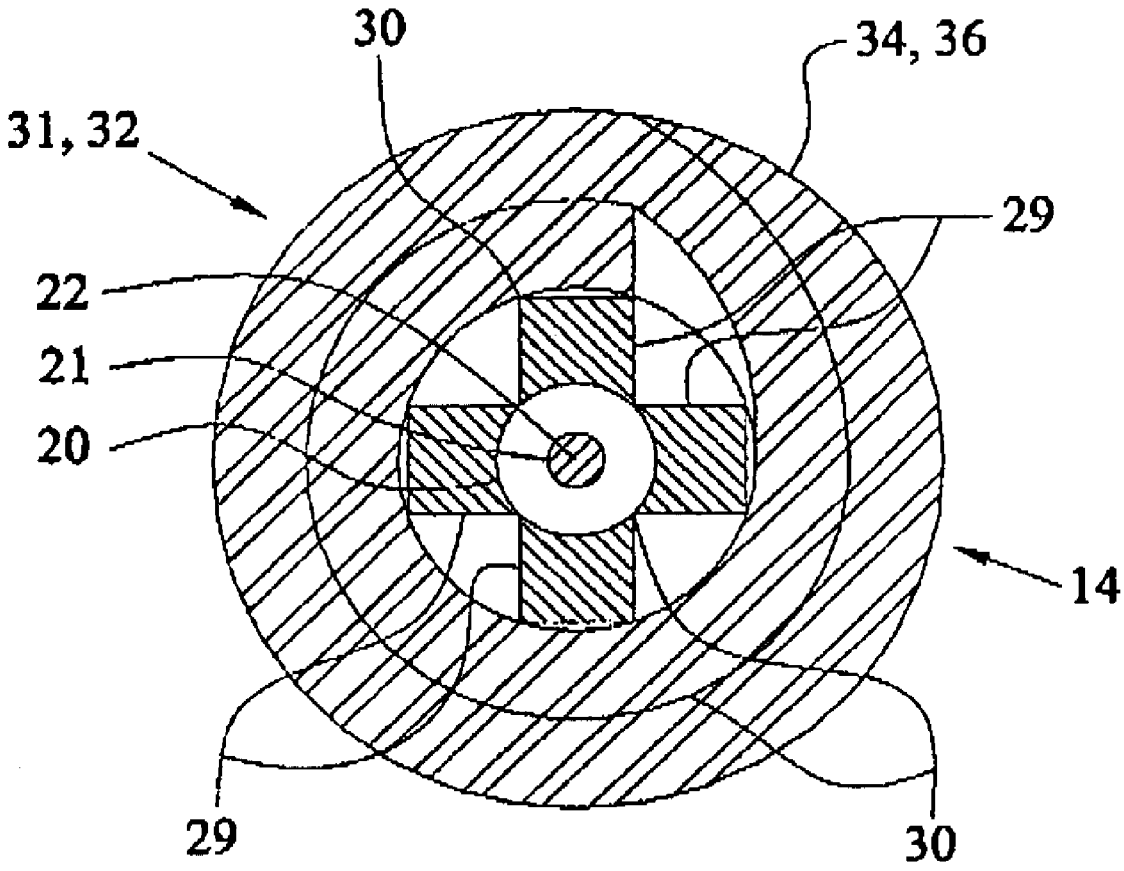
FIG. 3 is a schematic lateral cross-sectional view of one embodiment of a replaceable section of the modular sponson of the invention generally.

One embodiment of cylindrical section 14 is shown in FIG. 3 where each section 14 has four elongate pieces 29 of cellular material, such as closed cell foam, secured with glue or any other suitable bonding agent 30 on the outside of PVC tubing 20. The secured pieces 29 measure about one inch in width and thickness and orthogonally extend outward from tubing 20 for substantially the entire length of each section 14. Pieces 29 can be made from any of a number of proven plastic-like compounds such as NSR Blend (nitrile rubber, burna N) having a density of about 110 to 150 kg/m$^3$, a tensile strength of >400 kPa, vacuum water absorption of <5%. One manufacturer is Armacell LLC, 7600 Oakwood Street Ext., Melbane, N.C. 27302, phone 919-304-3846 and it is sold under their name Ensolite NG1-130 in thicknesses of 3 to 25 mm, 1 meter wide and 2 meters long.

A sheet 31 of cellular material such as closed cell foam is wrapped around tubing 20 and elongate pieces 29 in one or more layers 32 depending on the desired diameter or required cross-section to provide sufficient flotation structure and streamlined shape for cylindrical sections 14 of modular sponson 10. In the preferred embodiment, sheet 31 has a thickness of about one inch and a length that extends substantially the length of each cylindrical section 14. Sheet 31 can be made from a variety of proven man-made compounds such as the NBR Blend referred to above. The wrapped layers 32 also can be secured to elongate pieces 29 and each other by bonding agent 30 to hold them together.

The outer one of layers 32 can have a protective covering 34 that can also reach around the ends and be secured via bonding agent 30 onto tubing 20 of each section 14 to protect it from puncture, cuts, slashes, and the damage associated with the abuses of abrasion and impact routinely encountered during small boat operations. Covering 34 can be any of a number of waterproof, scuff resistant, pliable, tough layers and/or coatings that are currently used to resist abrasion and tearing in the design and manufacture of commercial inflatable boats. For example, one such proven synthetic covering is sold by Tuff-Coat SRC (Synergy Research Corporation), Blaine, Wash. 98230 and marketed as TUFF COAT. Another example would be a combination of the high strength, light weight synthetic fiber product KEVLARO by E.I. DuPont de Nemours and Company and commercially available nitrile plan (coating).

Figure 4:
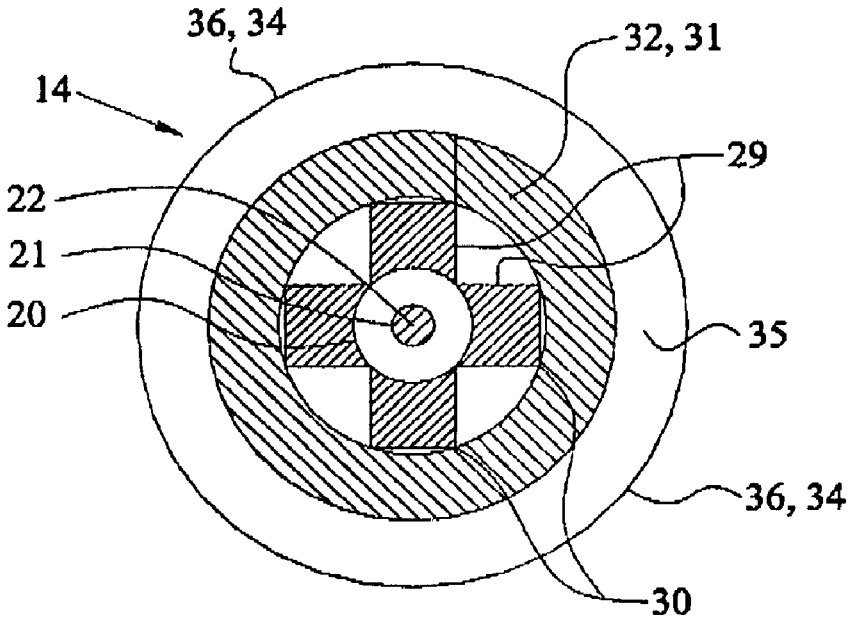
FIG. 4 is a schematic lateral cross-sectional view of another embodiment of a replaceable section of the modular sponson of the invention.

Referring to FIG. 4, another embodiment of cylindrical section 14 has the tubing 20 mounting orthogonally disposed elongate pieces 29 via a suitable bonding agent 30 like the previous embodiment. For sufficient flotation structure this embodiment has only a single layer 32 of closed cell foam material 31 glued onto pieces 29 via agent 30 and an outer tubular-shaped air-filled layer 35 contained inside a layer 36 of a rubberized heavy-duty material like that used in making/repairing contemporary sponsons in popular commercial and sport-model rubber boats. Rubberized layer 36 extends around opposite ends of each section 14 and can be connected to opposite ends of tubing 20 and other constituents of this embodiment by more of bonding agent 30.

An abrasion resistant protective covering or coating 34 can be applied over or under rubberized layer 36 using bonding agent 30, or protective covering 34 or layer 36 might have sufficient adhesive properties by themselves for further protection and sealing as desired. Hypalon (chlorosulfonated polyethylene) made by DuPont Company could be used and is sold by many companies for marine use as Hypalon® XD, a multilayered material usually consisting of four layers (from the outside in): hypalon, nylon or polyester core, neoprene, and a second layer of neoprene. Covering or coating 34 is also connected to opposite ends of each length of tubing 20 substantially the same way. The ends of the cylindrical section 14 also can have section-end-plates 14' (not shown in this FIG.) as described above. If plates 14' are included, they can be bonded to sections 14 or could be sandwiched between sections 14 as cable 22 holds them in compression.

Figure 5:
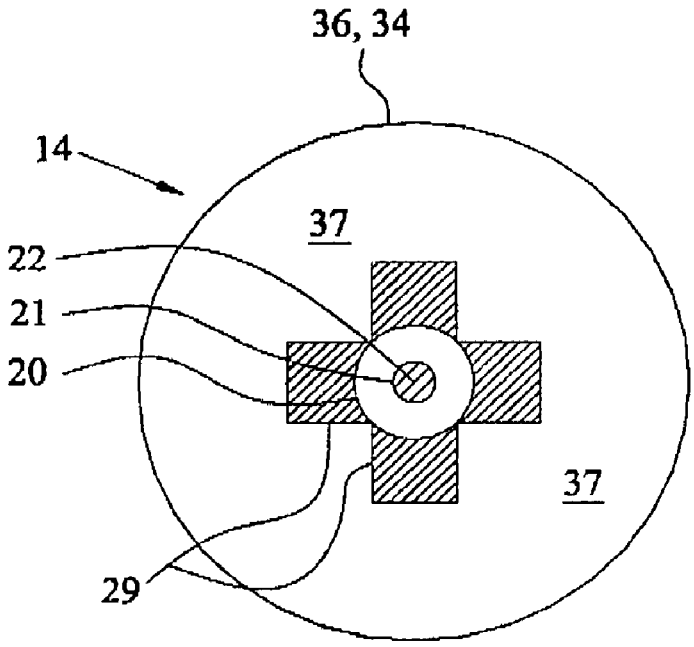
FIG. 5 is a schematic lateral cross-sectional view of still another embodiment of a replaceable section.

Referring to FIG. 5 still another embodiment of cylindrical section 14 has tubing 20 with glued-on elongate pieces 29 as described above. A rubberized layer 36 possibly fashioned according to predetermined dimensions in a preformed cylindrical shape is secured with bonding agent 30 to opposite ends of tubing 20 and pieces 29. Rubberized layer 36 thusly defines an essentially cylindrical-shaped chamber 37 when it is filled with pressurized air or other gas to provide sufficient flotation for each discrete section 14. An abrasion resistant covering 34 can be applied over rubberized layer 36 for further protection and sealing. In addition, section-end-plates 14' (not shown in FIG. 5) may be used and secured via more bonding agent 30 to rubberized layer 36 or covering 34 to further strengthen each discrete section 14 and make this embodiment of modular sponson 10 more rugged.

A small boat 12 having modular sponson 10 of the invention mounted on hull 11 does not need to travel to a distant repair depot when one or more of cylindrical sections 14 are damaged. Small boat 12 is taken from the water and placed on the beach or other convenient work area. Knotted or secured ends 23 and 24 can be taken apart or released, and cable 22 can be withdrawn or pulled out of lengths of tubing 20 of adjacent ones of cylindrical sections 14 in series 15. The damaged ones of sections 14 from bow 16 or sides 17 and 18 are removed from hull 11 by decoupling mating parts of juncture 13 on hull 11 and section 14 and rolling-away or lifting damaged sections 14 from modular sponson 10. The remainder of sponson 10 can remain intact and in place on hull 11.

A new cylindrical section 14 can be taken from the limited supply inventory that normally accompanies units operating in the field, or constituent parts of a cylindrical section 14 can be quickly assembled as described above into a new cylindrical section 14. These constituent parts can be the above described tubing 20, elongate pieces 29 and sheet 31 of closed cell foam, glue bonding-agent 30, and covering/layer 34/36, for examples. The new cylindrical section(s) 14 can be inserted into the gap(s) that were created by removing damaged section(s) 14 in modular sponson 10. Cable 22 is restrung through aligned bores 21 of tubing lengths 20; cable 22 is placed in tension to draw all sections 14 together in a smooth streamlined shape; and ends 23 and 24 are refastened to securely hold sections 14 as a strong interconnected modular sponson 10.

Having the teachings of this invention in mind, modular sponson 10 of the invention can be repaired and made to be operationally ready in short time by relatively untrained personnel. The cost and time savings provided by replaceable sections 14 of modular sponson of the invention is significant. Modifications and alternate embodiments of modular sponson 10 may be adapted, and differently configured sections 14 could be used in the construction of modular sponson 10 or all members could be made from a wide variety of materials to meet the requirements of different applications. For example, modified designs using sophisticated composite materials for modular sponson 10 of the invention can be readily created within the scope of one having ordinary skill in the art. In addition to the uncomplicated, highly functional unit described, modular sponson 10 could have different shapes, sizes and materials to create dynamically acceptable structures that accommodate different harsh operational conditions such as icy, bitter cold, arctic deployments.

The disclosed components and their arrangements, as disclosed herein, all contribute to the novel features of this invention. Modular sponson 10 is a rugged, functional means for assuring quick turn-around for fast boats having damaged sponsons to assure continuing effectiveness.

Modular sponson 10, as disclosed herein is not to be construed as limiting, but rather, is intended to be demonstrative of this inventive concept. It should be readily understood that many modifications and variations of the present invention are possible within the purview of the claimed invention. It is to be understood that within the scope of the appended claims the invention may be practiced otherwise than as specifically described.

We claim:

1. A modular sponson for a boat having a bow, sides and a stern comprising:

a plurality of discrete sections disposed in a series from said bow and along both said sides to said stern of said boat, each of said sections having an axially extending length of tubing defining a longitudinal opening, a plurality of elongate pieces of closed cell foam material secured to the outside of said tubing for substantially the entire length of each section, means outwardly disposed from and in contact with said elongate pieces for creating flotation structure, and a protective covering on the outside of said flotation structure creating means and reaching inwardly to opposite ends of each length of tubing, said elongate pieces of closed cell foam orthogonally extending outward from said tubing for substantially the entire length of each section of said series;

an elongate cable extending through said longitudinal openings of said series of sections, said cable exerting a tensile force holding said series of discrete sections adjacent one another in compression, and sections of said series in said modular sponson having substantially the same lateral and longitudinal outer dimensions;

a bonding agent disposed on mating surfaces between each length of tubing, elongate pieces, and flotation structure creating means;

a pair of end plates each having a hole, each of said pair of end plates being on a separate aft end of an end one of said discrete sections of said series on opposite sides of said boat at said stern, said cable extending through said holes in said end plates on end ones of said series of discrete sections; and securing means at opposite ends of said elongate cable for engaging said end plates by said cable.

2. The modular sponson of claim 1 wherein said securing means is configured to transfer said tensile force to said aft ends and hold said series of discrete sections in compression throughout the length of said cable.

3. The modular sponson of claim 2 wherein said protective covering is adapted to resist abrasion and tearing of each discrete section.

4. The modular sponson of claim 3 further comprising:

a rubberized coating disposed on said protective covering.

5. The modular sponson of claim 4 wherein said protective covering and said rubberized coating are secured to said flotation structure creating means and to each other.

6. The modular sponson of claim 2 wherein each said discrete section is cylindrical-shaped and said longitudinal opening axially extends through each cylindrical-shaped section.

7. The modular sponson of claim 6 wherein said flotation structure creating means comprises a sheet of flexible closed cell material wrapped around said elongate pieces in at least one continuous layer and said wrapped sheet is secured to said elongate pieces and itself by said bonding agent.

8. The modular sponson of claim 7 wherein said flotation structure creating means is a plurality of layers of said sheet of flexible closed cell material wrapped around said elongate pieces and secured together by said bonding agent.

9. The modular sponson of claim 8 further comprising:

section-end-plates disposed on opposite ends of each said discrete section, said section-end-plates having openings aligned with said longitudinal openings, said elongate cable extending through said section-end-plate openings.

10. The modular sponson of claim 7 wherein said flotation structure creating means further comprises an essentially tubular-shaped air-filled chamber outside of said wrapped layer and inside of said protective covering for each discrete section.

11. The modular sponson of claim 10 further comprising:

section-end-plates disposed on opposite ends of each said discrete section, said section-end-plates having openings aligned with said longitudinal openings, said elongate cable extending through said section-end-plate openings.

12. The modular sponson of claim 6 wherein said flotation structure creating means comprises an essentially cylindrical-shaped air-filled chamber outside of said elongate pieces and inside of said protective covering for each discrete section.

13. The modular sponson of claim 12 further comprising:

section-end-plates disposed on opposite ends of each said discrete section, said section-end-plates having openings aligned with said longitudinal openings, said elongate cable extending through said section-end-plate openings.

* * * * *